US008167046B2

(12) United States Patent
Hill, Jr. et al.

(10) Patent No.: US 8,167,046 B2
(45) **Date of Patent: *May 1, 2012**

(54) METHOD AND APPARATUS TO HYDRAULICALLY BYPASS A WELL TOOL

(75) Inventors: Thomas G. Hill, Jr., The Woodlands, TX (US); Jeffrey L. Bolding, Kilgore, TX (US); David Randolph Smith, Kilgore, TX (US)

(73) Assignee: Baker Hughes Incorporated, Houston, TX (US)

( * ) Notice: Subject to any disclaimer, the term of this patent is extended or adjusted under 35 U.S.C. 154(b) by 491 days.

This patent is subject to a terminal disclaimer.

(21) Appl. No.: 11/793,668

(22) PCT Filed: Dec. 22, 2005

(86) PCT No.: PCT/US2005/047007

§ 371 (c)(1),
(2), (4) Date: Feb. 29, 2008

(87) PCT Pub. No.: WO2006/069372

PCT Pub. Date: Jun. 29, 2006

(65) Prior Publication Data

US 2008/0308268 A1 Dec. 18, 2008

Related U.S. Application Data

(60) Provisional application No. 60/593,217, filed on Dec. 22, 2004.

(51) Int. Cl.
*E21B 43/16* (2006.01)
*E21B 23/03* (2006.01)

(52) U.S. Cl. ..... 166/305.1; 166/90.1; 166/129; 166/169; 166/183; 166/387

(58) Field of Classification Search ..... None
See application file for complete search history.

(56) References Cited

U.S. PATENT DOCUMENTS

| | | | |
|---|---|---|---|
| 12,143 | A | 1/1855 | Tucker |
| 2,416,842 | A | 3/1947 | O'Leary |
| 3,675,720 | A | 7/1972 | Sizer |

(Continued)

FOREIGN PATENT DOCUMENTS

| | | |
|---|---|---|
| CA | 2310236 | 12/2001 |

(Continued)

OTHER PUBLICATIONS

PCT International Search Report and Written Opinion corresponding to PCT/US2005/047007, dated Oct. 4, 2006.

(Continued)

*Primary Examiner* — Zakiya W Bates
(74) *Attorney, Agent, or Firm* — Parsons Behle & Latimer

(57) ABSTRACT

Apparatuses and methods to communicate with a zone below a subsurface safety valve (104, 204) independent of the position of a closure member (106) of the safety valve are disclosed. The apparatuses and methods include deploying a subsurface safety valve (104, 204) to a profile located within a string of production tubing. The subsurface safety valve (104, 204) is in communication with a surface station through an injection conduit (150,152; 250,252) and includes a bypass pathway (144, 244) to inject various fluids to a zone below.

27 Claims, 2 Drawing Sheets

U.S. PATENT DOCUMENTS

| | | | | |
|---|---|---|---|---|
| 3,923,099 | A * | 12/1975 | Brandon | 166/249 |
| 4,022,273 | A | 5/1977 | Marathe | |
| 4,387,767 | A | 6/1983 | Read | |
| 4,423,782 | A | 1/1984 | Bowyer | |
| 4,490,095 | A | 12/1984 | Soderberg | |
| 4,616,981 | A | 10/1986 | Simmons et al. | |
| 4,646,827 | A | 3/1987 | Cobb | |
| 5,092,400 | A | 3/1992 | Jagert | |
| 5,148,865 | A | 9/1992 | Reed | |
| 5,203,409 | A | 4/1993 | Seid et al. | |
| 5,522,464 | A | 6/1996 | Piper | |
| 5,662,169 | A | 9/1997 | Hosie | |
| 5,727,631 | A | 3/1998 | Baker et al. | |
| 5,915,475 | A | 6/1999 | Wells et al. | |
| 6,138,758 | A * | 10/2000 | Shaw et al. | 166/265 |
| 6,386,292 | B1 * | 5/2002 | Bland | 166/387 |
| 6,467,541 | B1 | 10/2002 | Wells | |
| 6,688,386 | B2 | 2/2004 | Cornelssen et al. | |
| 6,715,554 | B1 | 4/2004 | Cunningham et al. | |
| 6,776,239 | B2 | 8/2004 | Eslinger et al. | 166/308.1 |
| 6,851,478 | B2 | 2/2005 | Cornelssen et al. | |
| 7,025,132 | B2 | 4/2006 | Kent et al. | |
| 7,325,600 | B2 | 2/2008 | Sieben | |
| 7,699,099 | B2 | 4/2010 | Bolding et al. | |
| 2002/0000315 | A1 | 1/2002 | Kent et al. | |
| 2002/0134548 | A1 | 9/2002 | Lam et al. | |
| 2004/0112604 | A1 | 6/2004 | Milberger et al. | |
| 2004/0154790 | A1 | 8/2004 | Cornelssen et al. | |
| 2004/0262010 | A1 | 12/2004 | Milberger | |
| 2005/0022998 | A1 | 2/2005 | Rogers | |
| 2005/0175476 | A1 | 8/2005 | Patterson | |
| 2005/0249613 | A1 | 11/2005 | Jordan et al. | |
| 2006/0008364 | A1 | 1/2006 | Traylor | |
| 2008/0029271 | A1 | 2/2008 | Bolding et al. | |

FOREIGN PATENT DOCUMENTS

| | | |
|---|---|---|
| CA | 2497090 | 8/2006 |
| EP | 0637675 | 2/1995 |
| GB | 2377954 | 1/2003 |
| WO | WO9904137 | 1/1999 |
| WO | WO9920869 | 4/1999 |
| WO | WO0047868 | 8/2000 |

OTHER PUBLICATIONS

Search Report & Written Opinion dated Oct. 12, 2006 from PCT/US2005/35601.
Examiner's Second Examination Report dated Mar. 22, 2010 from related AU Patent Application No. AU2006279282.
Examiner's First Report dated Nov. 2, 2009 from related AU Patent Application No. AU2006279282.
First Exam Report dated Nov. 23, 2009 from related CA Patent Application No. 2619570.
Search Report and Written Opinion dated Sep. 27, 2007 from PCT Application No. PCT/US2006/32504.
Office Action dated Feb. 1, 2010 from related U.S. Appl. No. 11/463,937.
Final Office Action dated Sep. 16, 2009 from related U.S. Appl. No. 11/463,937.
International Preliminary Report on Patentability dated Feb. 12, 2009 from related PCT Application No. PCT/ US2007/017226.
International Search Report & Written Opinion dated Jan. 18, 2008 from related PCT Application No. PCT/US2007/017226.
Office Action dated Mar. 13, 2009 from related U.S. Appl. No. 11/461,858.
Office Action dated Aug. 4, 2008 from related U.S. Appl. No. 11/461,858.
Office Action dated Apr. 17, 2007 from U.S. Appl. No. 11/057,214.
Office Action dated Jun. 19, 2009 from related U.S. Appl. No. 11/461,858.
Office Action dated Dec. 31, 2008 from related U.S. Appl. No. 11/461,858.
"Conventional DHSV Coiled Tubing Completion" obtained from http://www.pedcor.com/wellhead-equipment/conventional_dhsv_ct_completion.html, 3-pgs.
"RF Hanger from PEDCOR " obtained from http://www.pedcor.com/wellhead-quipment/rf_hanger.html, 3-pgs.
PEDCOR "Series 10-400 Chemical Injector Adaptor" dated Jan. 5, 1995.
PEDCOR "Wellhead Equipment Sub: Standard Hanger Mandrel Type" obtained from http://www.pedcor.com/wellhead-equipmnet/standard_mandrel_hanger.html, 3-pgs.
Select Energy Systems, "Installation Procedure: Model 2500 CT Hanger", undated, obtained from http://www.selectesi.com/select_energy/PDFs/02.pdf, 2-pgs.
Select Energy Systems, "Model 2500 Flanged CT Hanger", Publisher: undated, obtained from http://www.selectesi.com/select_energy/PDFs/04.pdf, 1-pg.
Select Energy Systems, "Model 2500R Flanged CT Hanger", Publisher: undated, obtained from http://www.selectesi.com/select_energy/PDFs/01.pdf, 1-pg.
Office Action dated Sep. 15, 2009 from related U.S. Appl. No. 12/208,646.
Office Action dated Mar. 9, 2010 from related U.S. Appl. No. 12/208,646.
International Search Report and Written Opinion dated Apr. 23, 2008 from related PCT Application No. PCT/US2008/050752.
Office Action dated Sep. 15, 2009 from related U.S. Appl. No. 11/972,399.
Office Action dated Mar. 24, 2010 from related U.S. Appl. No. 11/972,399.
Canadian Office Action dated Aug. 13, 2008 from related Canadian Application No. CA 2,497,090.
Office Action dated Oct. 20, 2006 from related U.S. Appl. No. 11/057,214.
U.S. Appl. No. 11/463,937, filed Aug. 11, 2006 in the name of Jeffrey L. Bolding.
U.S. Appl. No. 11/972,399, filed Jan. 10, 2008, in the name of Jeffrey L. Bolding, et al.
U.S. Appl. No. 12/208,646, filed Sep. 11, 2008, in the name of Jeffrey L. Bolding, et al.
U.S. Appl. No. 12/420,425, filed Apr. 8, 2009, in the name of Jeffrey L. Bolding.
Extended European Search Report dated Aug. 30, 2011 from related European Application No. 05855548.3.

* cited by examiner

METHOD AND APPARATUS TO HYDRAULICALLY BYPASS A WELL TOOL

CROSS-REFERENCE TO RELATED APPLICATION

This application claims the benefit of provisional application U.S. Ser. No. 60/593,217 filed Dec. 22, 2004.

BACKGROUND OF THE INVENTION

The present invention generally relates to subsurface apparatuses used in the petroleum production industry. More particularly, the present invention relates to an apparatus and method to conduct fluid through subsurface apparatuses, such as a subsurface safety valve, to a downhole location. More particularly still, the present invention relates to apparatuses and methods to install a subsurface safety valve incorporating a bypass conduit allowing communications between a surface station and a lower zone regardless of the operation of the safety valve.

Various obstructions exist within strings of production tubing in subterranean wellbores. Valves, whipstocks, packers, plugs, sliding side doors, flow control devices, expansion joints, on/off attachments, landing nipples, dual completion components, and other tubing retrievable completion equipment can obstruct the deployment of capillary tubing strings to subterranean production zones. One or more of these types of obstructions or tools are shown in the following United States Patents which are incorporated herein by reference: Young U.S. Pat. No. 3,814,181; Pringle U.S. Pat. No. 4,520,870; Carmody et al. U.S. Pat. No. 4,415,036; Pringle U.S. Pat. No. 4,460,046; Mott U.S. Pat. No. 3,763,933; Morris U.S. Pat. No. 4,605,070; and Jackson et al. U.S. Pat. No. 4,144,937. Particularly, in circumstances where stimulation operations are to be performed on non-producing hydrocarbon wells, the obstructions stand in the way of operations that are capable of obtaining continued production out of a well long considered depleted. Most depleted wells are not lacking in hydrocarbon reserves, rather the natural pressure of the hydrocarbon producing zone is so low that it fails to overcome the hydrostatic pressure or head of the production column. Often, secondary recovery and artificial lift operations will be performed to retrieve the remaining resources, but such operations are often too complex and costly to be performed on all wells. Fortunately, many new systems enable continued hydrocarbon production without costly secondary recovery and artificial lift mechanisms. Many of these systems utilize the periodic injection of various chemical substances into the production zone to stimulate the production zone thereby increasing the production of marketable quantities of oil and gas. However, obstructions in the producing wells often stand in the way of deploying an injection conduit to the production zone so that the stimulation chemicals can be injected. While many of these obstructions are removable, they are typically components required to maintain production of the well so permanent removal is not feasible. Therefore, a mechanism to work around them would be highly desirable.

The most common of these obstructions found in production tubing strings are subsurface safety valves. Subsurface safety valves are typically installed in strings of tubing deployed to subterranean wellbores to prevent the escape of fluids from the wellbore to the surface. Absent safety valves, sudden increases in downhole pressure can lead to disastrous blowouts of fluids into the atmosphere. Therefore, numerous drilling and production regulations throughout the world require safety valves be in place within strings of production tubing before certain operations are allowed to proceed.

Safety valves allow communication between the isolated zones and the surface under regular conditions but are designed to shut when undesirable conditions exist. One popular type of safety valve is commonly referred to as a surface controlled subsurface safety valve (SCSSV). SCSSVs typically include a closure member generally in the form of a circular or curved disc, a rotatable ball, or a poppet, that engages a corresponding valve seat to isolate zones located above and below the closure member in the subsurface well. The closure member is preferably constructed such that the flow through the valve seat is as unrestricted as possible. Usually, the SCSSVs are located within the production tubing and isolate production zones from upper portions of the production tubing. Optimally, SCSSVs function as high-clearance check valves, in that they allow substantially unrestricted flow therethrough when opened and completely seal off flow in one direction when closed. Particularly, production tubing safety valves prevent fluids from production zones from flowing up the production tubing when closed but still allow for the flow of fluids (and movement of tools) into the production zone from above.

SCSSVs normally have a control line extending from the valve, said control line disposed in an annulus formed by the well casing and the production tubing and extending from the surface. Pressure in the control line opens the valve allowing production or tool entry through the valve. Any loss of pressure in the control line closes the valve, prohibiting flow from the subterranean formation to the surface.

Closure members are often energized with a biasing member (spring, hydraulic cylinder, gas charge and the like, as well known in the industry) such that in a condition with no pressure, the valve remains closed. In this closed position, any build-up of pressure from the production zone below will thrust the closure member against the valve seat and act to strengthen any seal therebetween. During use, closure members are opened to allow the free flow and travel of production fluids and tools therethrough.

Formerly, to install a chemical injection conduit around a production tubing obstruction, the entire string of production tubing had to be retrieved from the well and the injection conduit incorporated into the string prior to replacement often costing millions of dollars. This process is not only expensive but also time consuming, thus it can only be performed on wells having enough production capability to justify the expense. A simpler and less costly solution would be well received within the petroleum production industry and enable wells that have been abandoned for economic reasons to continue to operate.

SUMMARY OF THE INVENTION

The deficiencies of the prior art are addressed by an assembly to inject fluid around a well tool located within a string of production tubing.

In one embodiment, an assembly to inject fluid from a surface station around a well tool located within a string of production tubing, the assembly comprises a lower anchor socket located in the string of production tubing below the well tool, an upper anchor socket located in the string of production tubing above the well tool, a lower injection anchor seal assembly engaged within the lower anchor socket, an upper injection anchor seal assembly engaged within the upper anchor socket, a first injection conduit extending from the surface station to the upper injection anchor seal assembly, the first injection conduit in communication with a first hydraulic port of the upper anchor socket, a second injection conduit extending from the lower injection anchor seal assembly to a location below the well tool, the second injection conduit in communication with a second hydraulic port of the lower anchor socket, and a fluid pathway to bypass the well tool and allow hydraulic communication between the first hydraulic port and the second hydraulic port. The well tool can be a subsurface safety valve. The well tool can be selected from the group consisting of whipstocks, packers, bore plugs, and dual completion components.

In another embodiment, the lower anchor socket, the well tool, and the upper anchor socket can be a single tubular sub in the string of production tubing.

In yet another embodiment, the lower anchor socket, the well tool, and the upper anchor socket can each be a separate tubular sub in the string of production tubing, the lower anchor socket tubular sub threadably engaged to the well tool tubular sub and the well tool tubular sub threadably engaged to the upper anchor socket tubular sub.

In another embodiment, an assembly to inject fluid from a surface station around a well tool located within a string of production tubing comprises an operating conduit extending from the subsurface safety valve to the surface station through an annulus formed between the string of production tubing and a wellbore. The assembly can further comprise an alternative injection conduit extending from the surface station to the second hydraulic port. The assembly can further comprise an alternative injection conduit extending from the surface station to the first hydraulic port. The first or second injection conduit can include a check valve. The fluid pathway can be internal to the assembly. The fluid pathway can be a tubular conduit external to the assembly.

The assembly to inject fluid around a well tool located within a string of production tubing can further comprise at least one shear plug to block the first hydraulic port and the second hydraulic port from communication with a bore of the string of production tubing when the injection anchor seal assemblies are not engaged therein.

In yet another embodiment, an assembly to inject fluid around a well tool located within a string of production tubing comprises a lower anchor socket located in the string of production tubing below the well tool and an upper anchor socket located in the string of production tubing above the well tool, a lower injection anchor seal assembly engaged within the lower anchor socket and an upper injection anchor seal assembly engaged within the upper anchor socket, a lower injection conduit extending from the lower injection anchor seal assembly to a location below the well tool, the lower injection conduit in hydraulic communication with a hydraulic port of the lower anchor socket, an upper injection conduit extending from a surface station to the upper injection anchor seal assembly, the upper injection conduit in hydraulic communication with a hydraulic port of the upper anchor socket, and a fluid pathway extending between the upper and lower anchor sockets through an annulus between the string of production tubing and a wellbore, the fluid pathway in hydraulic communication with the upper and lower hydraulic ports. The well tool can be a subsurface safety valve. The well tool can be selected from the group consisting of whipstocks, packers, bore plugs, and dual completion components. The assembly can further comprise a check valve in at least one of the upper and lower injection conduits.

In another embodiment, an assembly to inject fluid around a well tool located within a string of production tubing comprises an anchor socket located in the string of production tubing below the well tool, an injection anchor seal assembly engaged within the anchor socket, an injection conduit extending from the injection anchor seal assembly to a location below the well tool, the injection conduit in hydraulic communication with a hydraulic port of the anchor socket, and a fluid pathway extending from a surface station through an annulus between the string of production tubing and a wellbore, the fluid pathway in hydraulic communication with the hydraulic port.

In yet another embodiment, an assembly to inject fluid around a well tool located within a string of production tubing further comprises an upper anchor socket located in the string of production tubing above the well tool, an upper injection anchor seal assembly engaged within the upper anchor socket, an upper injection conduit extending from the surface station to the upper injection anchor seal, the upper injection conduit in hydraulic communication with an upper hydraulic port of the upper anchor socket, and a second fluid pathway hydraulically connecting the upper hydraulic port with the hydraulic port of the anchor socket below the well tool.

In another embodiment, a method to inject fluid around a well tool located within a string of production tubing comprises installing the string of production tubing into a wellbore, the string of production tubing including a lower anchor socket below the well tool and an upper anchor socket above the well tool, installing a lower anchor seal assembly to the lower anchor socket, the lower anchor seal assembly including a lower injection conduit extending therebelow, installing an upper anchor seal assembly to the upper anchor socket, the upper anchor seal assembly disposed upon a distal end of an upper injection conduit extending from a surface station, and communicating between the upper injection conduit and the lower injection conduit through a fluid pathway around the well tool. The well tool can be a subsurface safety valve.

In yet another embodiment, a method to inject fluid around a well tool located within a string of production tubing further comprises installing an alternative injection conduit extending from the surface station to the lower anchor seal assembly.

In another embodiment, a method to inject fluid around a well tool located within a string of production tubing further comprises installing an alternative injection conduit extending from the surface station to the upper anchor seal assembly.

In another embodiment, a method to inject fluid around a well tool located within a string of production tubing further comprises restricting reverse fluid flow in the lower injection conduit with a check valve.

In yet another embodiment, a method to inject fluid around a well tool located within a string of production tubing comprises installing the string of production tubing into a wellbore, the string of production tubing including the well tool, an anchor socket above the well tool, and a lower string of injection conduit extending below the well tool, installing an anchor seal assembly to the anchor socket, the anchor seal assembly deposed upon a distal end of an upper string of injection conduit extending from a surface station, and communicating between the upper string of injection conduit and the lower string of injection conduit through a fluid pathway extending from the anchor seal assembly to the lower string of injection conduit around the well tool. The well tool can be selected from the group consisting of subsurface safety valves, whipstocks, packers, bore plugs, and dual completion components.

In another embodiment, a method to inject fluid around a well tool located within a string of production tubing comprises installing the string of production tubing into a wellbore, the string of production tubing including the well tool and an anchor socket below the well tool, installing an anchor seal assembly to the anchor socket, the anchor seal assembly including a lower injection conduit extending therebelow, deploying a fluid pathway from a surface location to the anchor socket through an annulus formed between the string of production tubing and the wellbore, and providing hydraulic communication between the surface location and the lower injection conduit through the fluid pathway.

In yet another embodiment, a method to inject fluid around a well tool located within a string of production tubing comprises providing an upper anchor socket in the string of production tubing above the well tool, installing an upper anchor seal assembly to the upper anchor socket, the upper anchor seal assembly disposed upon a distal end of an upper injection conduit extending from the surface location, and communicating between the upper injection conduit and the lower injection conduit through a second fluid pathway extending between the upper anchor seal assembly and the anchor seal assembly located in the anchor socket below the well tool.

In another embodiment, a method to inject fluid around a well tool located within a string of production tubing comprises installing the string of production tubing into a wellbore, the string of production tubing including a lower anchor socket below the well tool providing an inner chamber circumferentially spaced about a longitudinal axis of the lower anchor socket, an upper anchor socket above the well tool providing an inner chamber circumferentially spaced about a longitudinal axis of the upper anchor socket, and a fluid pathway on an exterior of the well tool hydraulically connecting the inner chambers of the upper and lower anchor sockets, establishing a fluid communication pathway between an inner surface of the upper and lower anchor sockets and the respective circumferentially spaced inner chambers, installing a lower anchor seal assembly to the lower anchor socket, the lower anchor seal assembly including a lower injection conduit extending therebelow, installing an upper anchor seal assembly in the upper anchor socket, the upper anchor seal assembly disposed upon a distal end of an upper injection conduit extending from a surface station, and communicating between the upper and lower injection conduits through the fluid communication pathway of the upper anchor socket, the fluid pathway, and the fluid communication pathway of the lower anchor socket.

DETAILED DESCRIPTION OF THE PREFERRED EMBODIMENTS

Figure 1:
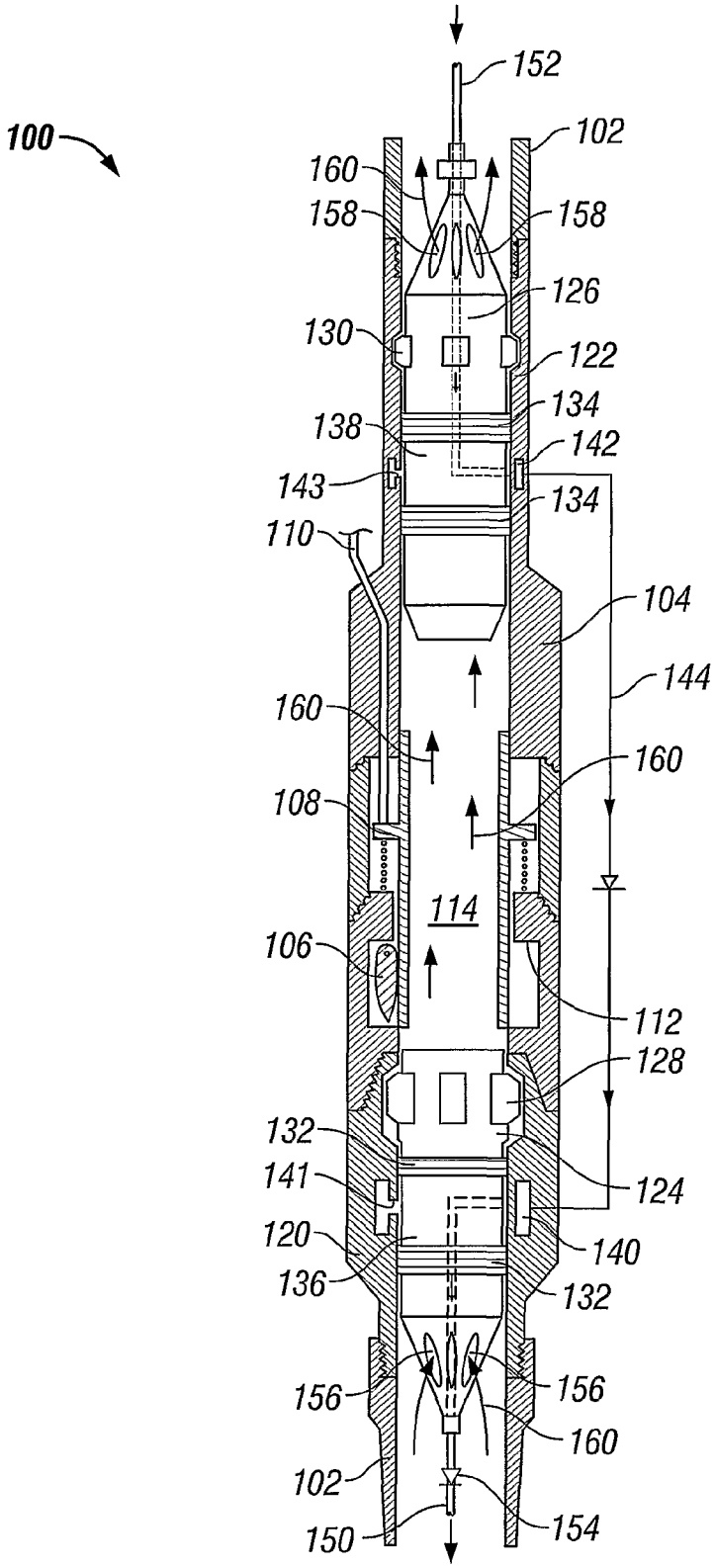
FIG. 1 is a schematic section-view drawing of a fluid bypass assembly in accordance with an embodiment of the present invention wherein the fluid bypass pathway may be used with any industry standard SCSSV.

Referring initially to FIG. 1, a fluid bypass assembly 100 according to an embodiment of the present invention is shown. Fluid bypass assembly 100 is preferably run within a string of production tubing 102 and allows fluid to bypass a well tool 104. In FIG. 1, well tool 104 is shown as a subsurface safety valve but it should be understood by one skilled in the art that any well tool deployable upon a string of tubing can be similarly bypassed using the apparatuses and methods of the present invention. Nonetheless, well tool 104 of FIG. 1 is a subsurface safety valve run in-line with production tubing 102, and includes a flapper disc 106, an operating mandrel 108, and a hydraulic control line 110. Flapper disc 106 is preferably biased such that as operating mandrel 108 is retrieved from the bore of a valve seat 112, disc 106 closes and prevents fluids below safety valve 104 from communicating uphole. Hydraulic control line 110 operates operating mandrel 108 into and out of engagement with flapper disc 106, thereby allowing a user at the surface to manipulate the status of flapper disc 106.

Furthermore, fluid bypass assembly 100 includes a lower anchor socket 120 and an upper anchor socket 122, each configured to receive an anchor seal assembly 124, 126. Upper 126 and lower 124 anchor seal assemblies are configured to be engaged within anchor sockets 120, 122 and transmit injected fluids across well tool 104 with minimal obstruction of production fluids flowing through bore 114. Anchor seal assemblies 124, 126 include engagement members 128, 130 and packer seals 132, 134. Engagement members 128, 130 are configured to engage with and be retained by anchor sockets 120, 122, which may include an engagement profile. While one embodiment for engagement members 128, 130 and corresponding anchor sockets 120, 122 is shown schematically, it should be understood that numerous systems for engaging anchor seal assemblies 124, 126 into anchor sockets 120, 122 are possible without departing from the present invention.

Packer seals 132, 134 are located on either side of injection port zones 136, 138 of anchor seal assemblies 124, 126 and serve to isolate injection port zones 136, 138 from production fluids 160 traveling through bore 114 of well tool 104 and/or the bore of the string of production tubing 102. Furthermore, injection port zones 136, 138 are in communication with hydraulic ports 140, 142 in the circumferential wall of fluid bypass assembly 100 and hydraulic ports 140, 142 are in communication with each other through a hydraulic bypass pathway 144. Hydraulic ports 140, 142 can include a fluid communication pathway 141, 143 between an inner surface of the upper and lower anchor socket 120, 122 and a respective circumferentially spaced inner chamber in each anchor socket. Hydraulic ports 140, 142 may include a plurality of fluid communication pathways 141, 143. A hydraulic port 140, 142 may also communicate directly with the hydraulic bypass pathway 144 without the shown circumferentially spaced inner chamber.

Hydraulic bypass pathway 144 is shown schematically on FIG. 1 as an exterior line connecting hydraulic ports 140 and 142, but it should be understood that hydraulic bypass pathway 144 can be either a pathway inside (not shown) the body of bypass assembly 100 or an external conduit. Regardless of internal or external construction, hydraulic bypass pathway 144, hydraulic ports 140, 142, and packer seals 132, 134 enable injection port zone 138 to hydraulically communicate with injection port zone 136 without contamination from production fluids 160 flowing through bore 114 of well tool 104 and/or the bore of the string of production tubing 102. Additionally, it should be understood by one of ordinary skill in the art that it may be desired to use the production tubing 102 and well tool 104 of assembly 100 before anchor seal assemblies 124, 126 are installed into sockets 120, 122. As such, any premature hydraulic communication around well tool 104 between hydraulic ports 140 and 142 through hydraulic bypass pathway 144 could compromise the functionality of well tool 104 and such communication would need to be prevented. Therefore, shear plugs (not shown) can be located in hydraulic ports 140, 142 prior to deployment of well tool 104 upon production tubing 102 to prevent hydraulic bypass pathway 144 from allowing communication before it is desired. The shear plugs could be constructed to shear away and expose hydraulic ports 140 and 142 when anchor seal assemblies 124, 126, or another device, are engaged thereby.

A lower string of injection conduit 150 is suspended from lower anchor seal assembly 124 and upper anchor seal assembly 126 is connected to an upper string of injection conduit 152. Because lower injection conduit 150 is in communication with injection port zone 136 of lower anchor seal assembly 124 and upper injection conduit 152 is in communication with injection port zone 138 of upper anchor seal assembly 126, fluids flow from upper injection conduit 152, through hydraulic bypass pathway 144 to lower injection conduit 150. This communication may occur through an internal bypass pathway, shown as a dotted conduit in FIG. 1, in either or both of the upper or lower anchor seal assemblies 126, 124. As such, by using fluid bypass assembly 100, an operator can inject fluids below a well tool 104 regardless of the state or condition of well tool 104. Using fluid bypass assembly 100, fluids can be injected (or retrieved) past well tools 104 that would otherwise prohibit such communication. For example, where well tool 104 is a subsurface safety valve, the injection can occur when the flapper disc 106 is closed.

To install bypass assembly 100 of FIG. 1, the well tool 104, lower anchor socket 120 and upper anchor socket 122 are deployed downhole in-line with the string of production tubing 102. Once installed, well tool 104 can function as designed until injection below well tool 104 is desired. Once desired, lower anchor seal assembly 124 is lowered down production tubing 102 bore until it reaches well tool 104. Preferably, lower anchor seal assembly 124 is constructed such that it is able to pass through upper anchor socket 122 and bore 114 of well tool 104 without obstruction en route to lower anchor socket 120. Once lower anchor seal assembly 124 reaches lower anchor socket 120, it is engaged therein such that packer seals 132 properly isolate injection port zone 136 in contact with hydraulic port 140.

With lower anchor seal assembly 124 installed, upper anchor seal assembly 126 is lowered down production tubing 102 upon a distal end of upper injection conduit 152. Because upper anchor seal assembly 126 does not need to pass through bore 114 of well tool 104, it can be of larger geometry and configuration than lower anchor seal assembly 124. With upper anchor seal assembly 126 engaged within upper anchor socket 122, packer seals 134 isolate injection port zone 138 in contact with hydraulic port 142. Once installed, communication can occur between upper injection conduit 152 and lower injection conduit 150 through hydraulic ports 142, 140, injection port zones 138, 136, and hydraulic bypass pathway 144. Optionally, a check valve 154 can be located in lower injection conduit 150 to prevent production fluids 160 from flowing up to the surface through upper injection conduit 152. A check valve may be located in any section of the upper 152 or lower 150 injection conduits as well as the hydraulic bypass pathway 144. A check valve can be integrated into the upper or lower anchor seal assemblies 126,124.

Ports 156, 158 in lower and upper anchor seal assemblies 124, 126 allow the flow of production fluids 160 to pass through with minimal obstruction. Furthermore, in circumstances where well tool 104 is to be a device that would not allow lower anchor seal assembly 124 to pass through a bore 114 of a well tool 104, the lower anchor seal assembly 124 can be installed before the production tubing 102 is installed into the well, leaving only upper anchor seal assembly 126 to be installed after production tubing 102 is disposed in the well.

Figure 2:
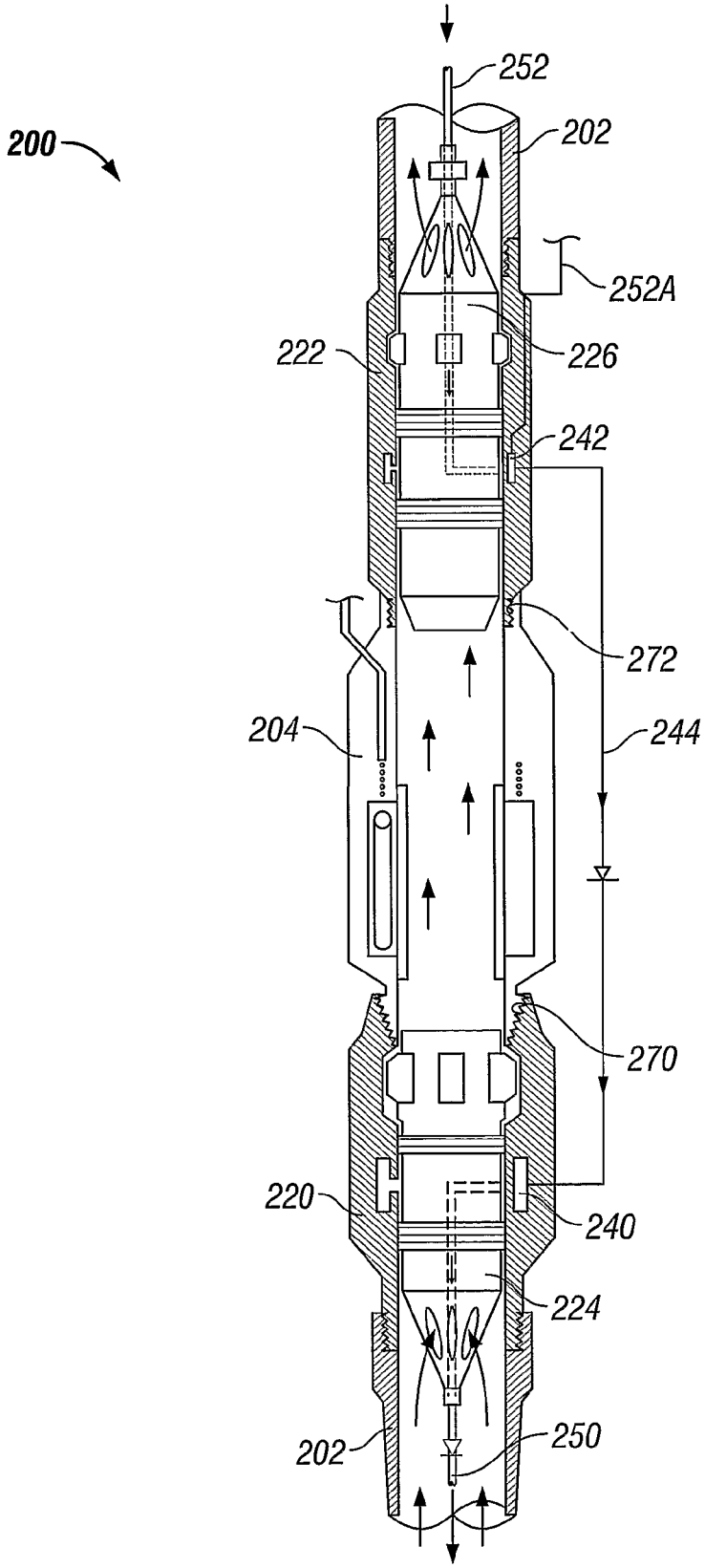
FIG. 2 is a schematic section-view drawing of a fluid bypass assembly in accordance with an alternative embodiment of the present invention wherein the fluid bypass pathway is integral to the SCSSV assembly.

Referring briefly now to FIG. 2, an alternative embodiment for a fluid bypass assembly 200 is shown. Fluid bypass assembly 200 differs from fluid bypass assembly 100 of FIG. 1 in that assembly 200 is constructed from several threaded components rather than the unitary arrangement detailed in FIG. 1. Particularly, a string of production tubing 202 is connected to a well tool 204 through anchor socket subs 222, 220. Well tool 204 is itself constructed as a sub with threaded connections 270, 272 on either end. Threaded connections 270, 272 allow for varied configurations of well tool 204 and anchor socket subs 220, 222 to be made. For instance, several well tools 204 can be strung together to form a combination of tools. Additionally, threaded connections 270, 272 allow more versatility and easier inventory management for remote locations, whereby an appropriate combination of anchor socket subs 220, 222 and well tools 204 can be made up for each particular well. Regardless of configuration of fluid bypass assembly 200, hydraulic bypass pathway 244 connects injection conduits 250 and 252 through hydraulic ports 240 and 242. Because of the modular arrangement of fluid bypass assembly 200, a hydraulic bypass pathway 244 is more likely to be an external conduit extending between anchor socket subs 220, 222, but with increased complexity, can still be constructed as an internal pathway, if so desired. The primary advantage derived from having hydraulic bypass pathway 244 as a pathway internal to fluid bypass assembly 200 is the reduced likelihood of damage from contact with the wellbore, well fluids, or other obstructions during installation. An internal hydraulic bypass pathway (not shown) would be shielded from such hazards by the bodies of anchor socket subs 220, 222 and well tool 204.

FIG. 2 further displays an alternative upper injection conduit 252A that may be deployed in the annulus between production tubing string 202 and the wellbore. Alternative upper injection conduit 252A would be installed in place of upper injection conduit 252 and would allow the injection of fluids into a zone below well tool 204 without the need for upper anchor seal assembly 226. Alternative upper injection conduit 252A would extend to hydraulic port 242 from the surface and communicate directly with hydraulic bypass pathway 244. Alternatively still, alternative upper injection conduit 252A could be installed in addition to upper injection conduit 252 to serve as a backup pathway to lower injection conduit 250 in the event of failure of upper injection conduit 252, hydraulic port 242, or upper anchor seal assembly 226. Furthermore, alternative upper injection conduit 252A can communicate directly with lower anchor seal assembly 224 through hydraulic port 240 if desired. A check valve may be located in any section of the upper 252 or lower 250 injection conduits as well as the hydraulic bypass pathway 244. A check valve can be integrated into the upper or lower anchor socket subs 222, 220.

Numerous embodiments and alternatives thereof have been disclosed. While the above disclosure includes the best mode belief in carrying out the invention as contemplated by the inventors, not all possible alternatives have been disclosed. For that reason, the scope and limitation of the present invention is not to be restricted to the above disclosure, but is instead to be defined and construed by the appended claims.

What is claimed is:

1. A bypass assembly to inject fluid around a well tool, the bypass assembly comprising:

an anchor socket located in a string of production tubing below the well tool;

a seal assembly engaged within the anchor socket;

a first conduit extending from a location above the anchor socket to the seal assembly, the first conduit bypassing the well tool and being in communication with a port of the anchor socket; and a second conduit suspended in the string of production tubing from the seal assembly to a location below the anchor socket, the second conduit being in communication with the port of the anchor socket, thereby allowing fluid communication between the first and second conduits while bypassing the well tool.

2. A bypass assembly as defined in claim 1, wherein the seal assembly is a lower seal assembly and wherein the anchor socket is a lower anchor socket, the bypass assembly further comprising:

an upper anchor socket located in the string of production tubing above the well tool;

an upper seal assembly engaged within the upper anchor socket; and an upper conduit extending from a surface station to the upper seal assembly, the upper conduit being in communication with a port of the upper anchor socket, wherein the first conduit of the lower anchor socket is in communication with the port of the upper anchor socket.

3. A bypass assembly as defined in claim 2, the bypass assembly further comprising an injection conduit extending from a surface station, through a housing of the upper anchor socket and to the port of the upper anchor socket.

4. A bypass assembly as defined in claim 2, wherein the anchor socket, the well tool, and the upper anchor socket are a single tubular sub in the string of production tubing.

5. A bypass assembly as defined in claim 2, wherein the anchor socket, the well tool, and the upper anchor socket are each a separate tubular sub in the string of production tubing, the anchor socket tubular sub threadably engaged to the well tool tubular sub and the well tool tubular sub threadably engaged to the upper anchor socket tubular sub.

6. A bypass assembly as defined in claim 2, the bypass assembly further comprising at least one shear plug to block the ports of the lower and upper anchor sockets from communication with a bore of the string of production tubing when the upper and lower seal assemblies are not engaged therein.

7. A bypass assembly as defined in claim 1, wherein the well tool is a subsurface safety valve.

8. A bypass assembly as defined in claim 7, the bypass assembly further comprising an operating conduit extending from the subsurface safety valve to a surface station through an annulus formed between the string of production tubing and a wellbore.

9. A bypass assembly as defined in claim 1 wherein the well tool is selected from the group consisting of whipstocks, packers, bore plugs, and dual completion components.

10. A bypass assembly as defined in claim 1, wherein a check valve is placed along the second conduit.

11. A bypass assembly as defined in claim 1, wherein a check valve is placed along the first conduit.

12. A bypass assembly as defined in claim 1 wherein the first conduit is internal to a body of the bypass assembly.

13. A bypass assembly as defined in claim 1 wherein the first conduit is a tubular conduit external to a body of the bypass assembly.

14. A bypass assembly to inject fluid around a well tool located within a string of production tubing, the assembly comprising:

a seal assembly located within the string of production tubing below the well tool;

a first conduit extending from a location above the seal assembly, the first conduit bypassing the well tool and being in communication with the seal assembly; and a second conduit suspended in the string of production tubing from the seal assembly to a location below the well tool, the second conduit being in communication with the seal assembly, thereby allowing fluid communication between the first and second conduits while bypassing the well tool.

15. A bypass assembly as defined in claim 14, wherein the seal assembly is a lower seal assembly, the bypass assembly further comprising:

an upper seal assembly located above the well; and an upper conduit extending from a port of the upper seal assembly up to a surface station, the first conduit of the lower seal assembly being in communication with the port of the upper seal assembly.

16. A bypass assembly as defined in claim 15, wherein the upper and lower seal assemblies are engaged within anchor sockets.

17. A bypass assembly as defined in claim 15, the bypass assembly further comprising a check valve in at least one of the first, second, and upper conduits.

18. A bypass assembly as defined in claim 14, wherein the well tool is a subsurface safety valve.

19. A bypass assembly as defined in claim 14, wherein the well tool is selected from the group consisting of whipstocks, packers, bore plugs, and dual completion components.

20. A method to inject fluid around a well tool, the method comprising the steps of:

(a) installing a string of production tubing into a wellbore, the string of production tubing including an anchor socket below the well tool;

(b) installing a seal assembly into the anchor socket, the seal assembly communicating with a first injection conduit extending above the anchor socket bypassing the well tool and a second injection conduit suspended in the string of production tubing below the anchor socket; and (c) communicating fluid between the first and second injection conduits, the fluid being allowed to bypass the well tool.

21. A method as defined in claim 20, wherein the anchor socket is a lower anchor socket, the method further comprising the steps of:

installing an upper anchor socket above the well tool;

installing an upper seal assembly into the upper anchor socket, the upper seal assembly disposed upon a distal end of an upper injection conduit extending from a surface station; and communicating between the upper injection conduit and the first injection conduit, thereby allowing fluid communication around the well tool.

22. A method as defined in claim 20, wherein the well tool is a subsurface safety valve.

23. A method as defined in claim 20, the method further comprising the steps of installing an alternative injection conduit extending from a surface station to a housing of the upper seal assembly, and allowing fluid communication between the alternative injection conduit and the first injection conduit.

24. A method as defined in claim 20, the method further comprising the step of preventing reverse fluid flow in the second injection conduit with a check valve.

25. A method to inject fluid around a well tool located within a string of production tubing, the method comprising the steps of:

(a) setting a seal assembly within the string of production tubing below the well tool;

(b) passing a fluid into a first conduit extending from a location above the well tool, the first conduit bypassing the well tool and being in communication with the seal assembly; and (c) passing the fluid into a second conduit suspended in the string of production tubing from the seal assembly to a location below the seal assembly, the second conduit being in communication with the first conduit of the seal assembly, thereby allowing fluid communication between the first and second conduits while bypassing the well tool.

26. A method as defined in claim 25, wherein the seal assembly is a lower seal assembly, the method further comprising the steps of:

setting an upper seal assembly above the well tool, the upper seal assembly comprising an upper conduit extending from a surface location;

passing a fluid into the upper conduit;

passing the fluid from the upper conduit into the first conduit of the lower seal assembly while bypassing the well tool; and passing the fluid from the first conduit of the lower seal assembly into the second conduit of the lower seal assembly.

27. A method to inject fluid around a well tool located within a string of production tubing comprising:

installing the string of production tubing into a wellbore, the string of production tubing including a lower anchor socket below the well tool providing an inner chamber circumferentially spaced about a longitudinal axis of the lower anchor socket, an upper anchor socket above the well tool providing an inner chamber circumferentially spaced about a longitudinal axis of the upper anchor socket, and a fluid pathway on an exterior of the well tool hydraulically connecting the inner chambers of the upper and lower anchor sockets;

establishing a fluid communication pathway between an inner surface of the upper and lower anchor sockets and the respective circumferentially spaced inner chambers;

installing a lower anchor seal assembly to the lower anchor socket, the lower anchor seal assembly including a lower injection conduit extending therebelow;

installing an upper anchor seal assembly in the upper anchor socket, the upper anchor seal assembly disposed upon a distal end of an upper injection conduit extending from a surface station; and communicating between the upper and lower injection conduits through the fluid communication pathway of the upper anchor socket, the fluid pathway, and the fluid communication pathway of the lower anchor socket.

* * * * *